US007003884B2

(12) United States Patent
Perlmutter et al.

(10) Patent No.: US 7,003,884 B2
(45) Date of Patent: Feb. 28, 2006

(54) CUTTING TOOL

(76) Inventors: Thomas Perlmutter, 22231 Mullholond Hwy., Suite 104, Calabasa, CA (US) 91302; Robert L. Lewis, 24910 Paseo Del Rancho, Calabasas, CA (US) 91302

( * ) Notice: Subject to any disclaimer, the term of this patent is extended or adjusted under 35 U.S.C. 154(b) by 56 days.

(21) Appl. No.: 10/453,330

(22) Filed: Jun. 3, 2003

(65) Prior Publication Data

US 2004/0244206 A1 Dec. 9, 2004

(51) Int. Cl.
*B26B 1/08* (2006.01)
*B26B 3/00* (2006.01)

(52) U.S. Cl. ..... 30/162; 30/293; 30/294; 83/13; 83/39

(58) Field of Classification Search ..... 30/162, 30/335, 336, 293, 294, 304, 305, 155; 83/13, 83/39

See application file for complete search history.

(56) References Cited

U.S. PATENT DOCUMENTS 4,604,804 A * 8/1986 Sparks ..... 30/294
5,768,787 A * 6/1998 Ireland ..... 30/294
5,890,290 A * 4/1999 Davis ..... 30/2

* cited by examiner

*Primary Examiner*—Douglas D Watts
(74) *Attorney, Agent, or Firm*—Marcia A. Devon

(57) ABSTRACT

A cutting tool includes a housing having a first end with a first edge and a second end. A handle extends from the second end of the housing. The housing has a slideable blade with a cutting position and a retracted position inside the housing. A finger portion is cantilevered from the first end of the housing. The finger portion and the first edge define an elongated opening having a juncture end at the first end of the housing. A cutting edge is embedded at the juncture end. The cutting edge is shaped, sized and orientated to facilitate forward slitting of heavy plastic sheet. The slideable blade slides axially along a track. A biasing means repositions the slideable blade from the cutting position to the retracted position.

6 Claims, 2 Drawing Sheets

CUTTING TOOL

CROSS-REFERENCE TO RELATED APPLICATIONS

U.S. Design Patent Application

STATEMENT REGARDING FEDERALLY SPONSORED RESEARCH OR DEVELOPMENT

Not Applicable

REFERENCE TO MICROFICHE APPENDIX

Not Applicable

FIELD OF INVENTION

The present invention relates generally to cutting tools and more particularly to a knife for cutting heavy plastic.

BACKGROUND OF THE INVENTION

Product packaging has undergone substantial change in recent years. The packaging must withstand the rigors of shipping, impede shop-lifters, and attractively display the product for retail sales and hold the product in a compact container. Increasingly, the packaging material of choice has become plastic. The plastic is formed from heavy clear sheet to conform to the contours of the products and to display the products for the retail sales. The plastic packaging is very difficult to open safely. The heavy plastic resists cutting, but can become very sharp and cut the unwary consumer.

There is a clear need for devices that can easily and safely open heavy plastic wrapping.

BRIEF SUMMARY OF THE INVENTION

The invention incorporates a cutting blade with a housing and handle structure. The housing has a spring-biased blade. The spring-biased blade is extended into the cutting position. A small slit is cut into the heavy plastic wrap with the extended spring-biased blade. The end of the housing has an elongated finger portion for inserting into the slit created by the spring-biased blade so that the blade rests against the end of the slit. The blade is then urged forward extending the slit and opening the package.

The foregoing summary has outlined the more pertinent and important features of the present invention in order that the detailed description of the invention that follows may be better understood so the present contributions to the art may be more fully appreciated. Additional features of the present invention will be described hereinafter, which form the subject of the claims. It should be appreciated by those skilled in the art that the conception and the disclosed specific embodiment may be readily utilized as a basis for modifying or designing other structures and methods for carrying out the same purposes of the present invention. It also should be realized by those skilled in the art that such equivalent constructions and methods do not depart from the spirit and scope of the inventions as set forth in the appended claims.

BRIEF DESCRIPTION OF THE DRAWINGS

The invention will be more fully understood by reference to the following drawings that are for illustrative purposes only.

DETAILED DESCRIPTION

Figure 1:
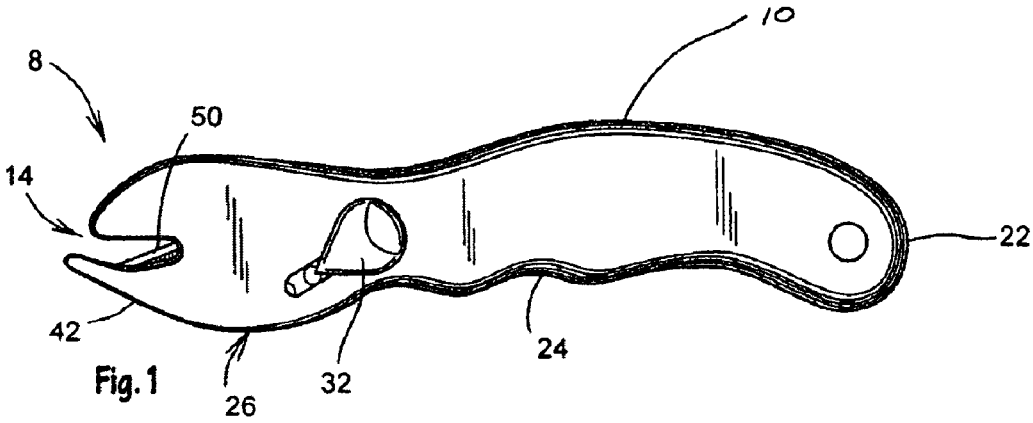
FIG. 1 is a left side view of cutting tool.
Figure 2:
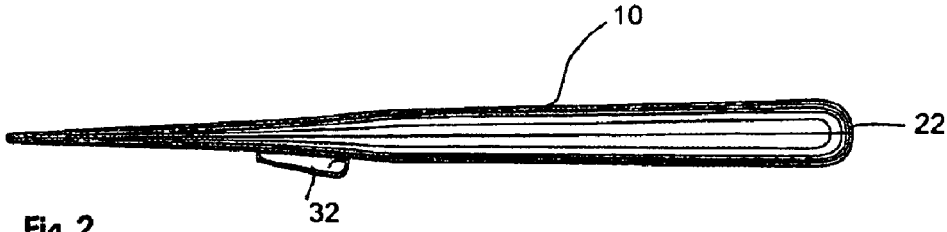
FIG. 2 is a plan view of cutting tool.
Figure 3:
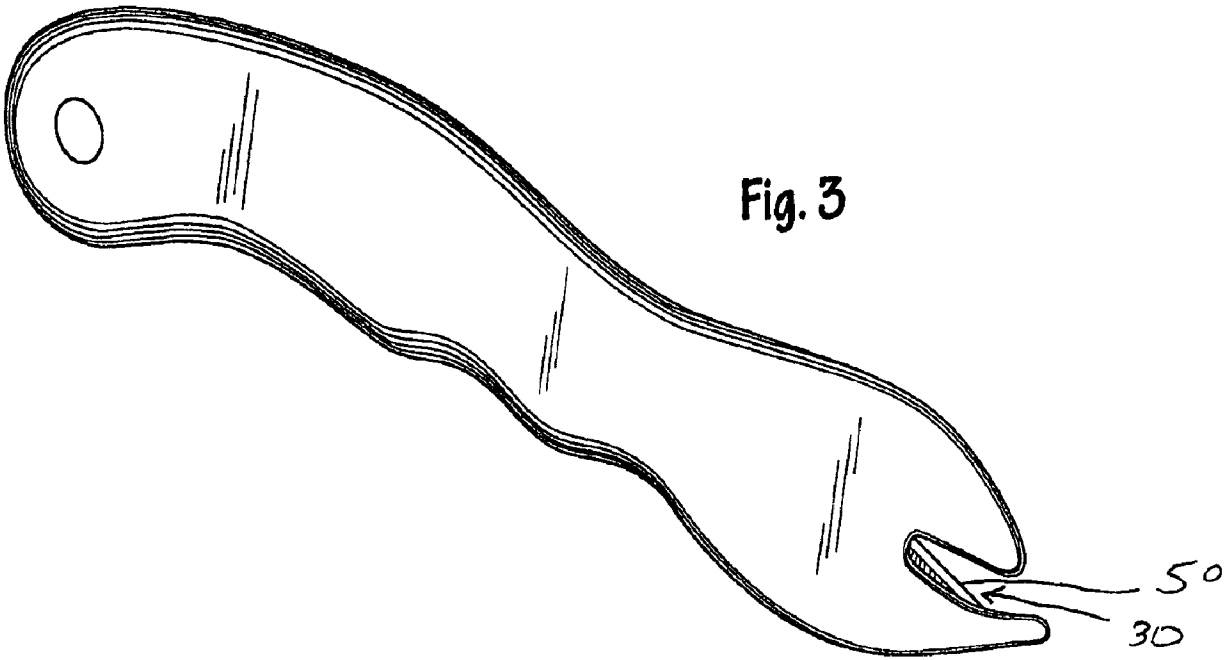
FIG. 3 is a right side view of cutting tool.
Figure 4:
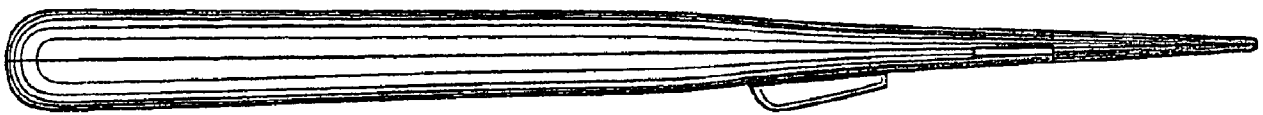
FIG. 4 is a bottom view of cutting tool.

A cutting tool 8 is shown in FIGS. 1–4. It includes a housing 10 having a first end 14 with a first edge 18 and a second end 22. A handle 24 extends from the second end 22 of the housing 10.

It also includes a first blade 26 with a cutting position 30 and a retracted position inside the housing 10. A relocation implement 32 moves the first blade 26 from the retracted position to the cutting position 30.

An elongated finger portion 42 extends from the first end 14 of the housing 10 forming a cantilever. The finger portion 42 runs opposite the first edge 18 of the first end 14. The finger portion 42 and the first edge 18 define an elongated opening having a juncture end 46 at the first end 14 of the housing 10.

A second blade 50 is embedded at the juncture end 46. The second blade 50 is shaped, sized and orientated to facilitate forward slitting of heavy plastic sheet.

The relocation implement 32 includes a thumb tab 54, a track and a biasing means. The first blade 26 slides axially along the track. The biasing means repositions the first blade 26 from the cutting position 30 to the retracted position 34. The leading edge 38 of the first blade 26 is the cutting edge.

The housing 10 is substantially flat. The second blade 50 is orientated in the plane of the housing 10 at an obtuse angle to the finger portion 42.

The handle 24 is shaped, sized and orientated to facilitate hand gripping.

The present disclosure includes that contained in the present claims as well as that of the foregoing description. Although this invention has been described in its preferred forms with a certain degree of particularity, it is understood that the present disclosure of the preferred forms has been made only by way of example and numerous changes in the details of construction and combination and arrangement of parts may be resorted to without departing from the spirit and scope of the invention. Accordingly, the scope of the invention should be determined not only by the embodiments illustrated, but by the appended claims and their legal equivalents.

What is claimed is:

1. A cutting tool comprising:

a housing, said housing having a first end with a first edge and a second end;

a handle extending from the second end of said housing;

a first blade, sliding on a track in said housing, said first blade having a cutting position in which said first blade projects past the first end of the housing and a retracted position, a relocation implement that moves said first blade from said retracted position to said cutting position;

a finger portion projecting from said first end of said housing, said finger portion located opposite a first edge of said first end of said housing, said finger portion and said first edge defining an elongated opening a second blade embedded in said first end of said housing such that said second blade spans, said elongated opening, said second blade being adapted to facilitate forward slitting.

2. A cutting tool according to claim 1 wherein said relocation implement comprises a thumb tab, a track and a biasing means, said first blade slides axially along said track, said biasing means repositions said first blade from said cutting position to said retracted position.

3. A cutting tool according to claim 1 wherein the leading edge of said first blade is the cutting edge.

4. A cutting tool according to claim 1 wherein said housing is substantially flat and said cutting edge is orientated in the plane of said housing.

5. A method of cutting plastic packaging, with a knife having first and second blade and a finger said method comprising the steps of:

extending a first blade;

piercing the heavy plastic packaging making a slit with said first blade;

retracting said first blade;

positioning a finger portion under said packaging and the second blade into said slit so that a cutting edge abuts against said slit; and pressing said second blade into said slit and enlarging the slit to remove the plastic packaging.

6. The cutting tool of claim 1 wherein said second blade is diagonally placed across said elongated opening.

* * * * *